US009483030B2

(12) United States Patent
Miyahara

(10) Patent No.: US 9,483,030 B2
(45) Date of Patent: Nov. 1, 2016

(54) RADIO TIMEPIECE AND RECEIPT CONTROL METHOD

(71) Applicant: SEIKO EPSON CORPORATION, Tokyo (JP)

(72) Inventor: Fumiaki Miyahara, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/643,276

(22) Filed: Mar. 10, 2015

(65) Prior Publication Data

US 2015/0268637 A1 Sep. 24, 2015

(30) Foreign Application Priority Data

Mar. 18, 2014 (JP) ..... 2014-054446

(51) Int. Cl.
*G04R 20/00* (2013.01)
*G04R 20/10* (2013.01)

(52) U.S. Cl.
CPC ..... *G04R 20/10* (2013.01)

(58) Field of Classification Search
CPC ..... G04R 20/00; G04R 20/08; G04R 20/10; G04R 20/12
USPC ..... 368/47, 10, 55, 46, 64, 76, 14, 13, 185, 368/276, 278
See application file for complete search history.

(56) References Cited

U.S. PATENT DOCUMENTS 5,528,560 A * 6/1996 Ogiyama ..... G04G 3/022 368/47
2003/0198140 A1* 10/2003 Shimizu ..... G04G 3/02 368/47
2003/0219039 A1* 11/2003 Oguchi ..... G04G 3/02 370/503
2004/0228219 A1* 11/2004 Miyahara ..... G04C 9/02 368/47
2005/0129156 A1* 6/2005 Lourens ..... G04G 5/002 375/350
2008/0112269 A1* 5/2008 Lawton ..... G04G 5/002 368/10
2009/0016171 A1* 1/2009 Fujisawa ..... G04C 9/02 368/47
2010/0165795 A1* 7/2010 Elder ..... G04G 5/002 368/10
2014/0160898 A1* 6/2014 Kajitani ..... G04R 20/10 368/47

FOREIGN PATENT DOCUMENTS

JP 2006-119009 A 5/2006
JP 2008-203233 A 9/2008
JP 2012-189558 A 10/2012

* cited by examiner

*Primary Examiner* — Edwin A. Leon
(74) *Attorney, Agent, or Firm* — Global IP Counselors, LLP

(57) ABSTRACT

A receipt time determination unit of a control unit in a control circuit modifies a receipt time in a case where a gain determined by an AGC circuit in a receiver circuit unit is not less than a reference value, where it is discerned that there is an error in a time code by an error discernment unit of a TCO decoder unit in the control circuit unit, and where it is discerned that data of the time code is impacted by interference waves by an interference wave discernment unit of the TCO decoder unit.

6 Claims, 5 Drawing Sheets

RADIO TIMEPIECE AND RECEIPT CONTROL METHOD

CROSS-REFERENCE TO RELATED APPLICATIONS

This application claims priority to Japanese Patent Application No. 2014-054446 filed on Mar. 18, 2014. The entire disclosure of Japanese Patent Application No. 2014-054446 is hereby incorporated herein by reference.

BACKGROUND

1. Technical Field

The present invention relates to a radio timepiece that receives time information, and to a receipt control method.

2. Related Art

A radio controlled timepiece that receives standard radio waves and carries out a time calibration requires a duration of about 2 to 5 minutes to receive the radio wave; the time slot during which the radio wave is being received needs to be one where there is little magnetic noise and also where the timepiece is not removed from the arm. Therefore, in general, the receipt time has been set so that automatic receipt is started in the late night hours (see JP-A-2008-203233 (Patent Document 1), for example).

Such a radio controlled timepiece starts automatic receipt at, for example, 2:00 AM, and should receipt be successful, then the time is calibrated and receipt is carried out again 24 hours later. In the event of failure to receive due to a receipt error, however, then automatic receipt is carried out again one hour later, at 3:00; should receipt be successful at this time, then the time is calibrated. When receipt fails, then receipt is carried out 23 hours later, at 2:00 AM of the following night. In other words, the receipt start time has conventionally been fixed, for example, to 2:00 AM.

SUMMARY

In recent years, however, electrical machines that perform non-contact charging wirelessly have come to be used, and these electrical machines may possibly generate magnetic noise in the vicinity of, for example, a longwave band (30 to 300 kHz). As such, in instances where these electrical machines have spread and expanded into each home, there is concern that magnetic noise caused by wireless charging could end up being mixed with or superimposed on the longwave radio waves (for example, JJY: 40 kHz, 60 kHz) of a radio controlled timepiece, and that this mixing or superimposition could cause frequent receipt errors, even with automatic receipt.

In particular because the time when electrical machines that perform non-contact charging wirelessly are used is believed to be fixed to a certain extent, there is concern that it would end up being difficult to avoid receipt errors with the method where the receipt time is fixed to 2:00 AM, as stated above.

The present invention has been made in view of the circumstances described above, and addresses the problem of reliably avoiding receipt errors due to automatic receipt even in a case where noise impacts a received signal due to a machine for which the time of usage is believed to be fixed to a certain extent.

In order to solve the above problem, a radio timepiece as in the present invention is configured to receive standard radio waves having a time code and calibrate a time based on the standard radio waves. The radio timepiece includes an amplifier circuit configured to amplify a received signal of the standard radio waves, an automatic gain control circuit configured to adjust a gain of the amplifier circuit in accordance with strength of the received signal, a demodulating circuit configured to demodulate the received signal, a decoder unit configured to decode a signal demodulated by the demodulating circuit to acquire the time code, and a receipt time determination unit configured to modify a receipt time in a case where it is discerned that the received signal is impacted by noise based on an output of the automatic gain control circuit and the time code.

According to the present invention, a received signal of standard radio waves having a time code is amplified by an amplifier circuit and demodulated by a demodulating circuit. The demodulated signal is decoded by a decoder unit, and a time code is acquired. The gain of the amplifier circuit is adjusted in accordance with the strength of the received signal by the automatic gain control circuit. As such, analysis of the output of the automatic gain control circuit makes it possible to know the strength of the received signal. Analysis of the acquired time code makes it possible to know whether or not there is a receipt error. Therefore, the receipt time determination unit discerns whether or not the received signal is impacted by noise in light of the relationship between the strength of the received signal and the presence or absence of a receipt error, based on the output of the automatic gain control circuit and based on the time code. The receipt time determination unit modifies the receipt time in a case where it is discerned that the received signal is impacted by noise. As such, a receipt time where the received signal is impacted by noise is avoided when the automatic receipt is carried out, and therefore the occurrence of a receipt error is avoided.

In the radio timepiece described above, the configuration may be such that the radio timepiece further includes an interference wave discernment unit configured to discern whether or not the time code acquired by the decoder unit has only zeroes and the time code having only zeroes is acquired over a predetermined duration or longer. In a case where it is discerned that data of the time code having only zeroes is acquired over a predetermined duration or longer by the interference wave discernment unit, then it is believed that it is not simply that the received signal is weak, but rather the amplifier circuit is being strongly impacted by noise and has been saturated. In such a case, the receipt time determination unit discerns that the received signal is being impacted by noise, and modifies the receipt time. As a result thereof, a receipt time where noise has a strong impact is avoided when the automatic receipt is carried out, and therefore the occurrence of a receipt error is avoided.

In the radio timepiece described above, the configuration may be such that the radio timepiece further includes an error discernment unit configured to discern whether or not the time code acquired by the decoder unit has an error, and an interference wave discernment unit configured to discern whether or not data of the time code acquired by the decoder unit is data where zeroes are continuous over a predetermined duration or longer, the receipt time determination unit being further configured to discern that the received signal is impacted by the noise and modify the receipt time in a case where the output of the automatic gain control circuit is a reference value or greater, it is discerned that the time code having an error by the error discernment unit, and it is discerned that data of the time code having only zeroes is acquired over the predetermined duration or longer by the interference wave discernment unit.

In such a case, the error discernment unit discerns whether or not the time code acquired by the decoder unit has an error. The interference wave discernment unit discerns whether or not the data of the time code acquired by the decoder unit is data where zeroes are continuous over a predetermined duration or longer. In a case where the output of the automatic gain control circuit is a reference value or higher, then it is conceivable that either the received signal is weak or the amplifier circuit is being strongly impacted by noise and has been saturated. However, in a case where the output of the automatic gain control circuit is a reference value or higher and a case where the data of the time code is data where zeroes are continuous over a predetermined duration or longer, than it is believed that it is not simply that the received signal is weak, but rather the amplifier circuit is being strongly impacted by noise and has been saturated. At this time, it is also discerned that the time code has an error. As such, in a case where the output of the automatic gain control circuit is a reference value or greater, it is discerned that the time code has an error by the error discernment unit, and it is discerned that data of a time code having only zeroes is acquired over a predetermined duration or longer by the interference wave discernment unit, then the receipt time determination unit discerns that the received signal is being impacted by noise, and modifies the receipt time. As a result thereof, a receipt time where noise has a strong impact is avoided when the automatic receipt is carried out, and therefore the occurrence of a receipt error is avoided. The "reference value" is a concept which includes the maximum value of the output of the automatic gain control, a value that is 90% of the maximum value, or the like. This is also true in the description of the present invention below.

In the radio timepiece described above, the configuration may be such that the receipt time determination unit is further configured to discern that the received signal is impacted by the noise and modify the receipt time in a case where the output of the automatic gain control circuit is less than the reference value and it is discerned that the time code has the error by the error discernment unit.

In a case where the output of the automatic gain control circuit is less than a reference value, then it is believed that the received signal is being received correctly. Where the time code has an error in such a case, it is believed that the received signal is being temporarily impacted by noise. As such, the receipt time determination unit discerns that the received signal is being impacted by noise and modifies the receipt time in a case where the output of the automatic gain control circuit is less than a reference value and it is discerned that the time code has an error by the error discernment unit. As a result thereof, a receipt time where the received signal is impacted by noise is avoided when the automatic receipt is carried out, and therefore the occurrence of a receipt error is avoided.

In order to solve the above problem, a receipt control method as in the present invention is a receipt control method for a radio timepiece configured to receive standard radio waves having a time code and calibrate a time based on the standard radio waves. The receipt control method includes amplifying a received signal of the standard radio waves by an amplifier circuit, adjusting a gain of the amplifier circuit by an automatic gain control circuit in accordance with strength of the received signal, demodulating the received signal by a demodulating circuit, decoding, by a decoder unit, a signal demodulated by the demodulating circuit to acquire the time code, and modifying a receipt time in a case where it is discerned by a receipt time determination unit that the received signal is impacted by noise based on an output of the automatic gain control circuit and the time code.

BRIEF DESCRIPTION OF THE DRAWINGS

Referring now to the attached drawings which form a part of this original disclosure:

FIGS. 3A, 3B, and 3C are a view illustrating a 1 signal, a view illustrating a 0 signal, and a view illustrating a P signal, respectively;

DETAILED DESCRIPTION OF EMBODIMENTS

A preferred embodiment of the present invention shall be described in greater detail below, with reference to the accompanying drawings and the like. However, in each of the drawings, the dimensions and scales of each of the parts have been altered, where appropriate, from the actual ones. Also, the embodiment described below is a preferred specific example of the present invention, and therefore a variety of technically preferable limitations have been imposed, but the scope of the present invention is in no way intended to be limited to these modes except where the description below refers in particular to limiting the present invention.

<A: Overview of Electronic Timepiece>

Figure 1:
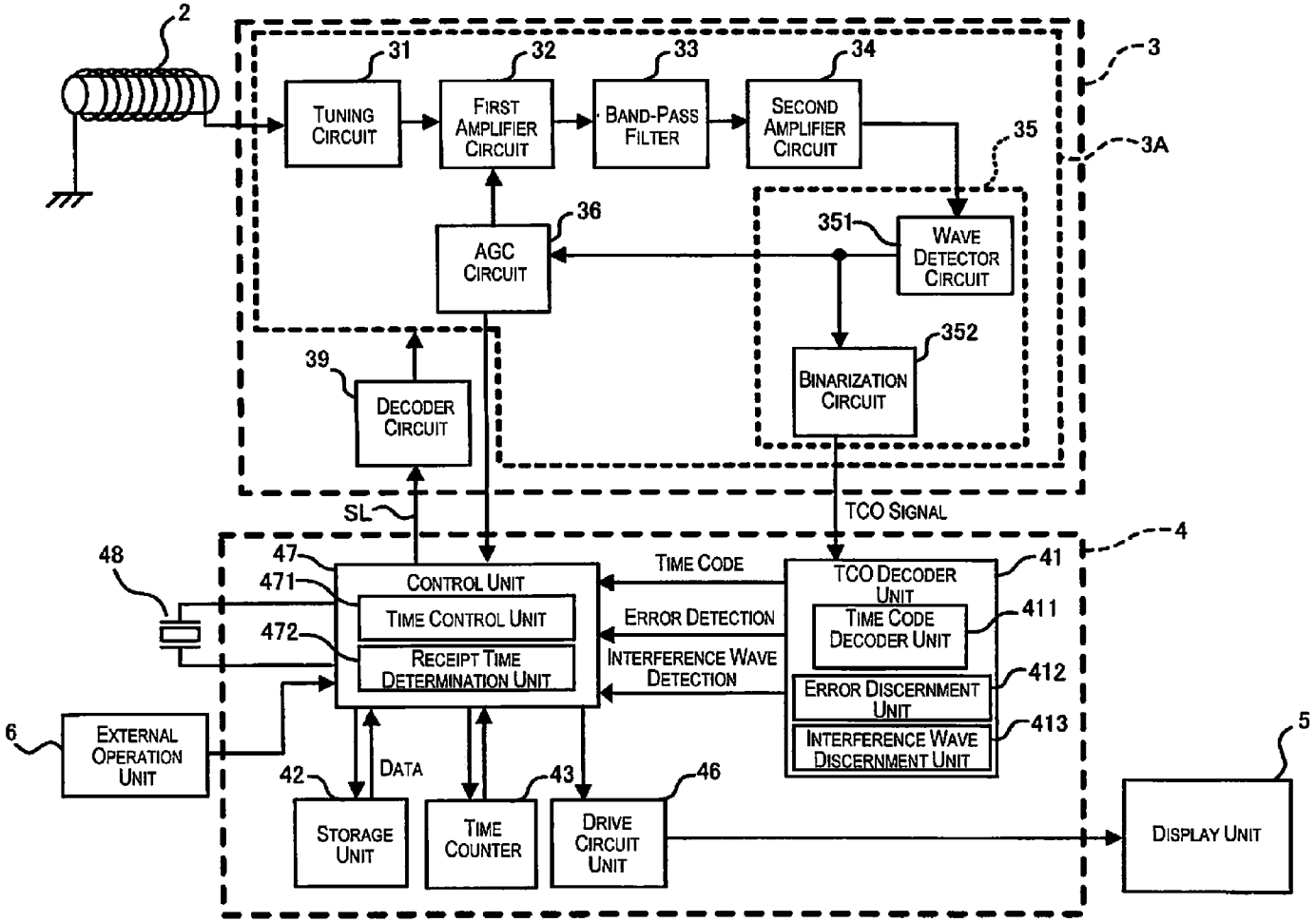
FIG. 1 is a block diagram of a radio controlled timepiece as in one embodiment of the present invention.

FIG. 1 illustrates a radio controlled timepiece 1 serving as a radio timepiece as in one embodiment of the present invention. The radio controlled timepiece 1 of the present embodiment, as illustrated in FIG. 1, is provided with an antenna 2, a receiver circuit unit 3, a control circuit unit 4, a display unit 5, an external operation unit 6, and a crystal oscillator 48.

The antenna 2 receives longwave standard radio waves (called "standard radio waves" hereinbelow), and outputs the received standard radio waves to the receiver circuit unit 3.

The receiver circuit unit 3 demodulates a received signal of the standard radio waves received at the antenna 2, and outputs same to the control circuit unit 4 as a time code out (time code output; TCO). The receiver circuit unit 3 shall be described in greater detail below.

The control circuit unit 4 decodes the inputted TCO, generates time data, and sets a time of a time counter 43 based on the generated time data. The control circuit unit 4 also implements a control for causing the display unit 5 to display the time of the time counter 43. Moreover, the control circuit unit 4 outputs a control signal to the receiver circuit unit 3. The control circuit unit 4 shall be described in greater detail below.

The display unit 5 is driven and controlled by a drive circuit unit 46 of the control circuit unit 4, and displays the time counted by the time counter 43. Examples of configurations that may serve as this display unit 5 include a configuration that is provided with a liquid crystal panel and that causes the time to be displayed on the liquid crystal panel in a digital format, or a configuration that is provided with a dial and hands, the hands being moved by the control circuit unit 4 to display the time.

The external operation unit 6 is constituted of, for example, a watch crown, a setting button, or the like, and operation by a user causes a predetermined operation signal to be outputted to the control circuit unit 4. Examples of this operation signal include a signal for setting the type of standard radio waves that are received by the antenna 2 (for example, JJY in Japan, WWVB in the U.S.A., and DCF77 in Germany, among others), or a signal for requesting a manual receipt process where the standard radio waves are received and the time is calibrated.

The crystal oscillator 48, for a reference clock, is intended to output predetermined clock signals, e.g., a 1-Hz reference signal for counting the time, a 32-kHz clock signal for operating a control unit 47, and the like; the clock signals outputted from this crystal oscillator 48 are inputted to the control circuit unit 4.

[Configuration of the Receiver Circuit Unit]

The receiver circuit unit 3, as illustrated in FIG. 1, is configured so as to be provided with a tuning circuit 31, a first amplifier circuit 32, a band-pass filter (also abbreviated as "BPF" in some instances below) 33, a second amplifier circuit 34, a demodulating circuit 35, an auto gain control (AGC) circuit 36, and a decoder circuit 39. The circuit of this receiver circuit unit 3, excluding the decoder circuit 39, constitutes a receiver unit 3A.

The tuning circuit 31 is configured so as to be provided with a capacitor; the tuning circuit 31 and the antenna 2 together constitute a parallel resonant circuit. This tuning circuit 31 causes radio waves of a specific frequency to be received at the antenna 2. The standard radio waves received at the antenna 2 because of this tuning circuit 31 are converted into a voltage signal, which is then outputted to the first amplifier circuit 32. The receiver circuit unit 3 of the present embodiment is configured so as to enable the receipt not only of Japan's standard radio waves "JJY", but also of standard radio waves in different regions such as the U.S.A.'s standard radio waves "WWVB", Germany's standard radio waves "DCF77", the U.K.'s standard radio waves "MSF", the P.R.C.'s "BPC", and so forth.

Herein, time information (a time code) is configured in accordance with a predetermined time information format (time code format) for each country.

Figure 2:
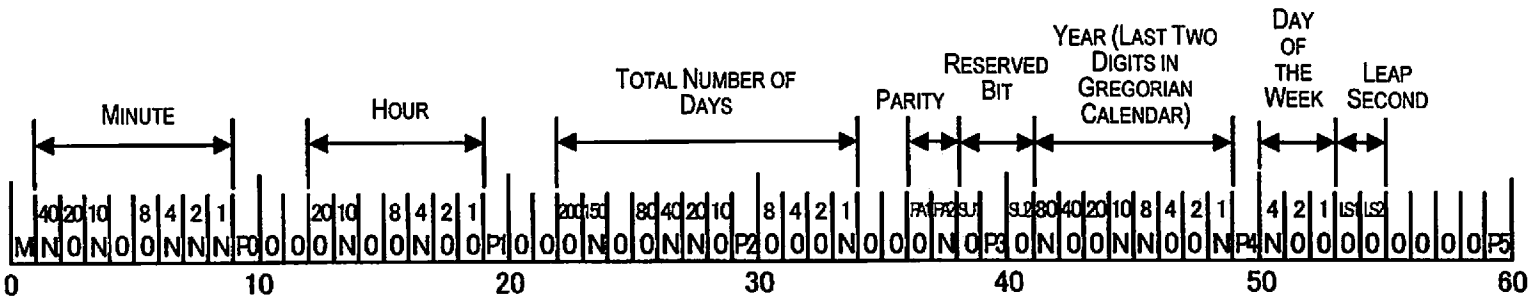
FIG. 2 is a view illustrating a time code format.

That is to say, in the time code format of Japan's standard radio waves (JJY) illustrated in FIG. 2, one signal is transmitted per second, constituting one record in 60 seconds. In other words, one frame is 60 bits of data. Also included as data items are the minute and hour of the current time, the total number of days since January 1 of the current year, the year (last two digits in the Gregorian calendar), the day of the week, and a "leap second". The value of each of the items is made up of a combination of numerical values assigned to every second; the ON or OFF status of this combination is determined from the type of signal. The "M" in FIG. 2 indicates a marker corresponding to the exact minute (0 second for every minute), while "P1" to "P5" and "P0" indicate position markers, and are signals for which the position has been defined in advance. The M (marker) and Ps (position markers), which are pulses having a narrow pulse width, are transmitted at the timings of 0 seconds, 9 seconds, 19 seconds, 29 seconds, 39 seconds, 49 seconds, and 59 seconds. The signals indicating the markers have a pulse width of about 0.2 seconds; the signal representing "ON" ("1" in binary) in each of the items has a pulse width of about 0.5 seconds, and the signal representing "OFF" ("0" in binary) has a pulse width of about 0.8 seconds.

The longwave standard radio waves (JJY) are transmitted in Japan at 40 kHz (eastern Japan) and 60 kHz (western Japan), but the time code formats of each of the radio waves are the same.

Though not shown, in Germany's time code format for standard radio waves (DCF77), respective data items for the minute, hour, day, day of the week, month, and year are set. Up to the 15th second, there is no data; therefore, the respective positions of the position markers P1, P2, P3, and the marker M are also different from JJY in FIG. 2. Items such as "R: backup antenna in use", "A1: announcement of change between normal time and summer time", "Z1, Z2: display of normal time and summer time", "A2: display of leap second", and "S: start bit for time code" are set before each of the time items.

Also, though not shown, in the U.S.A.'s time code format for standard radio waves (WWVB), respective data items for the minute, hour, day, and year are set. WWVB is like western Japan's JJY in that the frequency is 60 kHz, but the position of the year information and the like is different from JJY, and analyzing the data makes it possible to differentiate between JJY and WWVB.

Furthermore, though not shown, the U.K.'s time code format for standard radio waves (MSF) and the P.R.C.'s time code format for standard radio waves (BPC) are also different from those of other countries, and the output station of standard radio waves can be discerned by the format (data) of the receipt time information (time code).

The first amplifier circuit 32 is configured so that the gain can be adjusted in accordance with a signal inputted from the AGC circuit 36 (described later), and is also configured so as to enable selection between a normal receipt mode and high-sensitivity receipt mode in accordance with a signal inputted from the decoder circuit 39. That is to say, the first amplifier circuit 32 functions as an amplifier circuit for amplifying a received signal of the standard radio waves.

A variety of amplifier circuits that have been conventionally known can be utilized as this first amplifier circuit 32, but in the present embodiment, a differential amplifier circuit is used.

When the operating current is increased in the first amplifier circuit 32, the amplification factor (gain) changes, and the amplitude of the received signal ends up changing, too. Therefore, until a response of the AGC circuit 36 catches up, there is the possibility that an incorrect binarization process could end up being carried out in a binarization circuit 352 in the demodulating circuit 35. For this reason, in a case where the operating current has been modified, a control such as to reduce the resistance value of a load resistor needs to be carried out in conjunction so as to prevent the amplification factor from changing.

In this manner, in the high-sensitivity receipt mode of the present embodiment, only the current of the first amplifier circuit 32 is increased, and therefore any increase in current when the high-sensitivity receipt mode has been selected can be minimized, and the effect of enhancing receipt sensitivity can also be increased.

The first amplifier circuit 32, having had adjustments made to the gain, amplifies the received signal inputted from the tuning circuit 31 so that same is inputted to the BPF 33 as a constant amplitude. That is to say, depending on the signal inputted from the AGC circuit 36, the first amplifier circuit 32 either lowers the gain in a case where the amplitude is large or raises the gain in a case where the amplitude is small, thus amplifying the received signal so as to reach a constant amplitude.

The BPF 33 is a filter for extracting a signal of a desired frequency band. Namely, the act of passing through the BPF 33 causes anything other than a carrier wave component to be removed from the received signal inputted from the first amplifier circuit 32.

The second amplifier circuit 34 further amplifies the received signal inputted from the BPF 33, at a fixed gain.

The demodulating circuit 35 is provided with a wave detector circuit 351 and the binarization circuit 352.

The wave detector circuit 351 is configured so as to be provided with a rectifier (not shown) and a low-pass filter (LPF) (not shown); the received signal inputted from the second amplifier circuit 34 is rectified and filtered, and the resulting filtered envelope signal is outputted to the AGC circuit 36 and the binarization circuit 352.

That is to say, the demodulating circuit 35 functions as a demodulating circuit for demodulating the received signal.

The binarization circuit 352 is constituted of a binary comparator; the envelope signal inputted from the wave detector circuit 351 is compared against a predetermined threshold value (reference voltage) and binarized, and this binary signal, i.e., the TCO signal, is outputted.

More specifically, the binarization circuit 352 outputs a signal having high-level voltage to the control circuit unit 4 as the TCO signal in a case where the voltage of the envelope signal exceeds the reference voltage, and outputs a low-level signal having a lower voltage value than the high-level signal to the control circuit unit 4 as the TCO signal in a case where the voltage of the envelope signal is lower than the reference voltage. It would also be possible to configure so that a low-level signal is outputted to the control circuit unit 4 as the TCO signal in a case where the voltage of the envelope signal is higher than the reference voltage, and a high-level signal is outputted to the control circuit unit 4 as the TCO signal in a case where the voltage of the envelope signal is lower than the reference voltage.

The AGC circuit 36 outputs a signal for determining the gain of when the received signal is amplified at the first amplifier circuit 32, based on the received signal inputted from the wave detector circuit 351. The AGC circuit 36 also outputs this signal for determining the gain to the control unit 47 of the control circuit unit 4. That is to say, the AGC circuit 36 functions as an automatic gain control circuit for adjusting the gain of the amplifier circuit in accordance with the strength of the received signal.

The decoder circuit 39 is connected to the control circuit unit 4 (described below) via a serial communication line SL. This decoder circuit 39 decodes the control signal and clock signal inputted from the control circuit unit 4, and carries out, inter alia, a power on/off control of the receiver unit 3A.

[Configuration of the Circuit Unit]

The control circuit unit 4 is provided with the TCO decoder unit 41, a storage unit 42, the time counter 43, and the drive circuit unit 46.

The TCO decoder unit 41 is provided with a time code decoder unit 411, an error discernment unit 412, and an interference wave discernment unit 413.

The time code decoder unit 411: decodes the TCO signal inputted from the binarization circuit 352 of the receiver circuit unit 3; takes out time data, which has the date information, time information, and the like included in the TCO signal; and outputs the time data to the control unit 47. That is to say, the time code decoder unit 411 functions as a decoder unit for decoding the signal demodulated by the demodulating circuit and acquiring a time code.

Figure 3A:
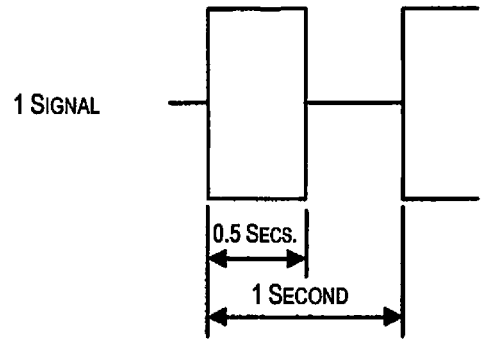
FIGS. 3A, 3B, and 3C are views illustrating time codes recognized from a TCO signal, where
Figure 3B:
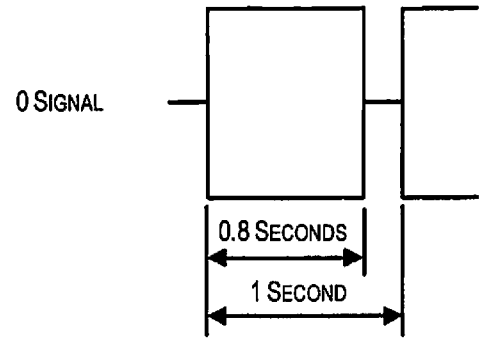
Figure 3C:
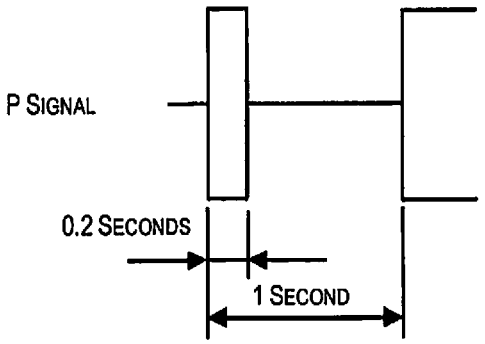

More specifically, the time code decoder unit 411 recognizes the waveform of the TCO signal and measures a received pulse duty with respect to a predetermined pulse width (for example, 1 Hz). The TC is then recognized from the TCO signal by differences in the received pulse duty. For example, in the standard radio waves (JJY) used domestically in Japan, a signal of "1" (a 1 signal) is recognized in a case where the pulse width of the high-level signal is 0.5 seconds with respect to a one-second pulse width (i.e., a case where the duty is 50%), as illustrated in FIG. 3A. Also, as illustrated in FIG. 3B, a signal of "0" (a 0 zero) is recognized in a case where the pulse width of the high-level signal is 0.8 seconds with respect to a one-second pulse width (i.e., a case where the duty is 80%). In a case where the pulse width of the high-level signal is 0.2 seconds with respect to a one-second pulse width (i.e., a case where the duty is 20%), as illustrated in FIG. 3C, then a "P" signal (P signal) is recognized. Thus, the TCO decoder unit 41 retrieves the predetermined time data by this sequence of recognized 1 signals, 0 signals, and P signals.

The description above illustrates the example of recognition of the TC in JJY, but in the event that the received standard radio waves are of another type, then the TC would be recognized by the duties corresponding to each of the radio waves. For example, with the standard radio waves in the U.S.A. (WWVB), though not shown here, the 1 signal would be recognized in a case where the duty is 50%, the 0 signal would be recognized in a case where the duty is 20%, and the P signal would be recognized in a case where the duty is 80%. Also, with the standard radio waves in Germany (DCF77), though not shown here, the 1 signal would be recognized in a case where the duty is 80% and the 0 signal would be recognized in a case where the duty is 90%; with the standard radio waves in the U.K. (MSF), though not shown here, the 1 signal would be recognized in a case where the duty is 80%, the 0 signal would be recognized in a case where the duty is 90%, and the P signal would be recognized in a case where the duty is 50%.

The error discernment unit 412 either discerns whether or not the data is such that there cannot be a time code or discerns whether or not there is an error by, inter alia, a method using a parity bit; in the event that it is discerned that there is an error, an error detection signal is outputted to the control unit 47. For example, it is discerned that there is an error when there is an abnormal value that exceeds the range of minute data, such as when the minute data indicated by the time code is "70 minutes" or the like. It is also discerned that there is an error in a case where the parity does not match. That is to say, the error discernment unit 412 functions as an error discernment unit for discerning whether or not an error is included in the time code acquired by the decoder unit.

The interference wave discernment unit 413 outputs an interference wave detection signal to the control unit 47 in a case where the data of the time code acquired by the time code decoder unit 411 includes only zeros and where the time code data is acquired over a predetermined duration or longer. That is to say, the interference wave discernment unit 413 functions as an interference wave discernment unit for discerning whether or not the time code acquired by the decoder unit has only zeros and this time code having only zeroes is acquired over a predetermined duration or longer.

The storage unit 42 is a memory for storing, inter alia, a variety of data and programs necessary for the control of the receiver circuit unit 3 by the control circuit unit 4 and the like. This storage unit 42 stores a radio wave data table which is set at the time of manufacture of the radio controlled timepiece 1 and in which radio wave data relating to the standard radio waves received at the receiver circuit unit 3 is recorded.

The radio wave data table is constructed to have a table structure in which radio wave data constituted of mutually associated radio wave type data and time code formats for every radio wave type forms one record and a plurality of sets of this radio wave data are recorded.

Herein, the radio wave type data is information pertaining to the type of standard radio waves being received at the receiver circuit unit 3; for example, JJY, WWVB, DCF77, MSF, or the like is recorded.

The time code format records the format of the time code (TC) included in the standard radio waves identified by the radio wave type data, i.e., records the sequence or sizes used in storing the respective data for the year, month, day, hour, and minute.

Time information data that has been received is also stored in the storage unit 42. In the present embodiment, the configuration allows for up to seven rounds of receipt time information data to be stored. Each of the sets of receipt time information data stored in the storage unit 42 includes data for respective time information units for the minute, hour, day, year, and day of the week.

The standard radio waves transmit the time data every minute, and therefore by receiving for up to seven minutes, seven sets of the time information data can be acquired. In this case, each of the sets of time information data will be time data that is different in one-minute increments. As such, it can be inferred that the correct time data has been received when the time data obtained by adding one minute to each of the sets of the receipt time information data matches the receipt time information data that is received next.

The time counter 43 is intended to count the time based on the reference signal outputted from the crystal oscillator 48, and is provided with a time counter for internal time data and a time counter for timepiece display time data.

More specifically, each of the counters is provided with a second counter for counting the seconds, a minute counter for counting the minutes, and an hour counter for counting the hours.

The second counter is a counter that loops the signal at a 60 count, i.e., 60 seconds in a case where, for example, the 1-Hz reference signal is being outputted from the crystal oscillator 48. The minute counter is a counter that counts by one where the 1-Hz reference signal has been counted 60 times, and loops at the 60 count, i.e., at 60 minutes. The hour counter is a counter that counts by one where the 1-Hz reference signal has been counted 3,600 times, and loops at the 24 count, i.e., at 24 hours.

The minute counter may also be a configuration where a signal is outputted from the second counter to the minute counter and the minute counter is counted up every time the second counter counts 60. Similarly, the hour counter may also be a configuration where a signal is outputted from the minute counter to the hour counter and the hour counter is counted up every time the minute counter counts 60.

The time counter for the internal time data is updated with the receipt time data in a case where the time information has been successfully received, and otherwise is counted up with the reference signal.

The time counter for the timepiece display time data ordinarily takes the same counter value as the time counter for the internal time data; however, in a case where a time difference display has been set by the user, then the time difference set by the user is added. For example, in a case where, when moving abroad from Japan, a time difference is set to display the local time after the radio controlled timepiece 1 was calibrated by receiving radio waves in Japan, then the counter would have a counter value that differs by an amount commensurate with the time difference.

Herein, the JJY time code format is configured so that one signal is transmitted every second and one record is formed at 60 seconds, as illustrated in FIG. 2. In other words, one frame is 60 bits of data. Also included as data items are current time information for the minute and hour, the total number of days since January 1 of the current year, the year (the last two digits in the Gregorian calendar), the day of the week, and any other such calendar information. The value of each of the items is made up of a combination of numerical values assigned to every second; the ON or OFF status of this combination is determined from the type of signal. As illustrated in FIGS. 3A, 3B, and 3C, the TCO signal includes the 1 signal, the 0 signal, and the P signal; with respect to the 1 signal, the state would be ON, and the numerical value associated with that item would be subject to addition when the hour and minute or the like is being calculated. In FIG. 2, the items where "N" is marked on the time code format of the longwave standard radio wave signal indicate a state where the 1 signal has been transmitted.

In a case where the 0 signal or the P signal has been transmitted, then the state is OFF, and the numerical value associated with that item is indicated as not being subject to addition when the hour and minute or the like is being calculated. In the example of a case where the longwave standard radio wave signal "1, 0, 1, 0, 0, 1, 1, 1" has been transmitted over the eight seconds corresponding to the minute, then this indicates that the minute of the current time is "40+10+4+2+1=57" minutes. The state where the P signal has been transmitted is indicated for items where "P" is marked on the time code format of the longwave standard radio wave signal. The P signal is used in order to synchronize the longwave standard radio wave signal and the time code format together. The "M" at the beginning of the time code corresponds to the start of the exact minute (the 0 second for every minute), and indicates that the second is "00" seconds and also indicates that the minute should be switched to the next minute. It should be noted that the longwave standard radio waves use a cesium atomic clock as a reference, and therefore a radio timepiece for receiving these longwave standard radio waves and calibrating the time is able to yield the very high accuracy of one second of error in 100,000 years.

The drive circuit unit 46 controls the display state of the display unit 5 and implements a control for causing the display unit 5 to display the time based on a time display control signal outputted from the control unit 47. In a case where, for example, the display unit 5 is a configuration that has a liquid crystal panel and displays the time on the liquid crystal panel, then the drive circuit unit 46 controls the liquid crystal panel and implements a control for causing the liquid crystal panel to display the time based on the time display control signal. In a case where the display unit 5 is a configuration that has a dial and hands, then the drive circuit unit 46 outputs a pulse signal to a stepping motor that drives the hands, and implements a control for moving the hands by the driving force of the stepping motor.

The control unit 47 is provided with a time control unit 471 and a receipt time determination unit 472.

The time control unit 471 drives and carries out a variety of control processes based on the clock signal inputted from the crystal oscillator 48. Namely, the control unit 471 outputs the time data obtained by decoding at the TCO decoder unit 41 to the time counter 43, and implements a control for calibrating the count of the time counter 43. The time control unit 471 also outputs to the drive circuit unit 46 a time display control signal to the effect that the display unit 5 should display the time counted by the time counter 43.

The time control unit 471 also outputs a control signal for controlling the power on/off of the receiver unit 3A to the decoder circuit 39 of the receiver circuit unit 3.

Specifically, the time control unit 471 transmits a control signal for powering on the receiver unit to put the receiver unit 3A into operation and start the receiving process in a case where a scheduled receipt time that has been set in advance is reached or in a case where manual receipt has been instructed with an external operation member 6.

The receipt time determination unit 472 discerns whether or not noise has had an impact on the received signal, based on the signal for determining the gain outputted from the AGC circuit 36 of the receiver circuit unit 3 and based on the error detection signal and interference wave detection signal that are outputted from the TCO decoder unit 41. The receipt time determination unit 472 determines the receipt time at which the standard radio waves are received in a case where it is discerned that noise has had an impact on the received signal. That is to say, the receipt time determination unit 472 functions as a receipt time determination unit for modifying the receipt time in a case where it has been discerned that noise has had an impact on the received signal at least based on the output of the automatic gain control circuit and based on the time code. The receipt time determination process executed by the receipt time determination unit 472 shall be described in greater detail below.

The control unit 47 and the decoder circuit 39 are connected to one another by the serial communication line SL, as stated above, and the control signal is inputted to the decoder circuit 39 via the serial communication line SL. Herein, in the serial communication between the control unit 47 and the receiver circuit unit 3, a two-wire synchronous interface allowing for two-way communication between the control unit 47 and the receiver circuit unit 3 may be used to carry out two-way serial communication thereby. In such a case, after the control signal has been outputted to the receiver circuit unit 3 from the control unit 47, the receiver circuit unit 3 again transfers the received and recognized control signal to the control unit 47, and confirming the difference between the data of the outputted control signal and inputted control signal at the control unit 47 makes it possible to carry out more highly reliable serial communication.

[Receipt Time Determination Process]

Next, the receipt time determination process executed by the receipt time determination unit 472 shall be described with reference to FIGS. 4, 5A, and 5B. The receipt time determination process executed by the receipt time determination unit 472 that is illustrated in FIG. 4 is carried out in parallel with the respective processes by the time control unit 471 described above.

Figure 4:
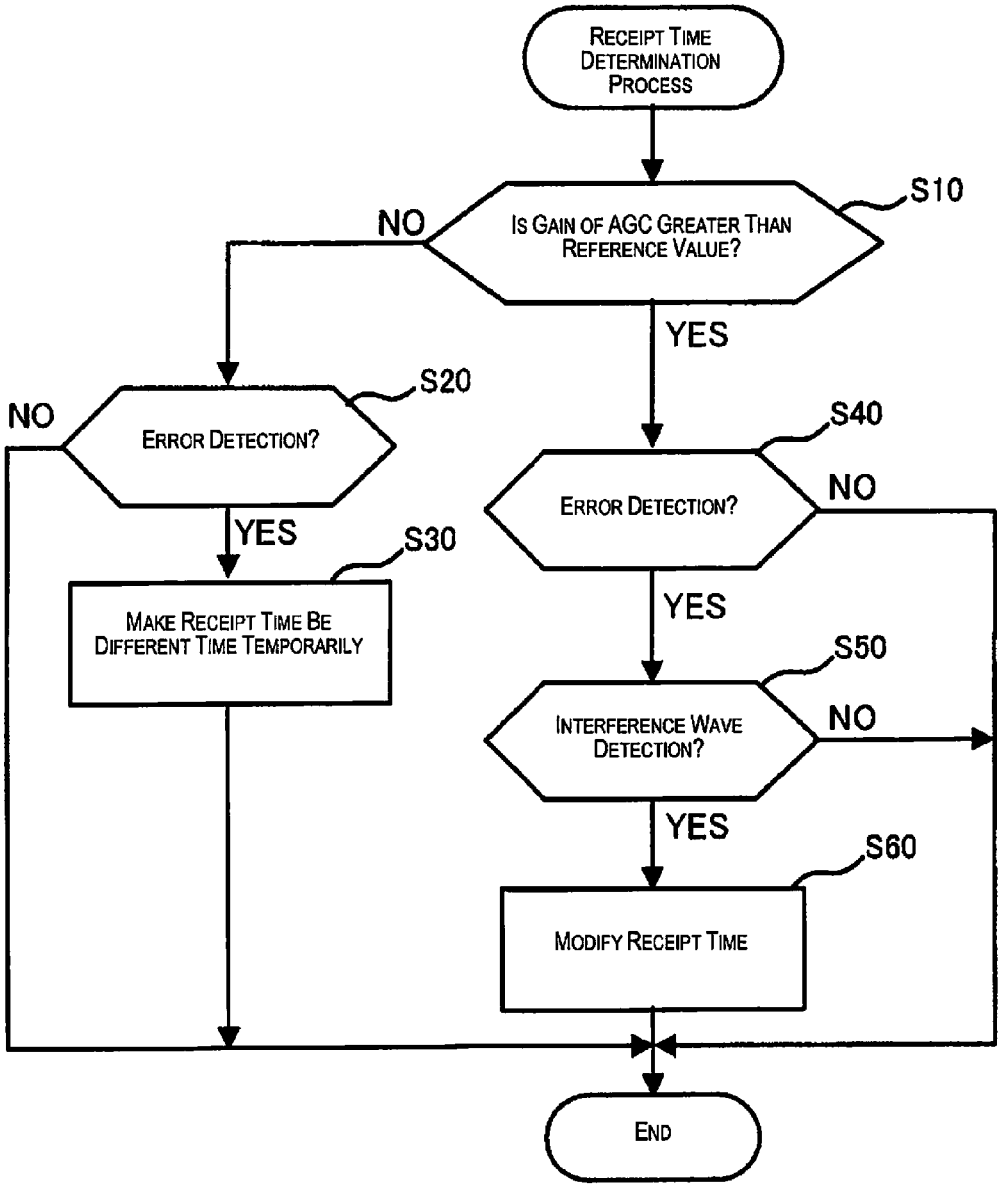
FIG. 4 is a flow chart illustrating a receipt time determination process.

As illustrated in FIG. 4, the receipt time determination unit 472 inputs the output signal of the AGC circuit 36, i.e., the signal for determining the gain of when the received signal is being amplified at the first amplifier circuit 32, and discerns whether the gain is greater than a predetermined reference value based on this signal (step S10). The predetermined reference value is, by way of example in the present embodiment, a value that is 90% of the maximum value of output of the AGC circuit 36. The same is also true in the description of the present embodiment below.

Figure 5A:
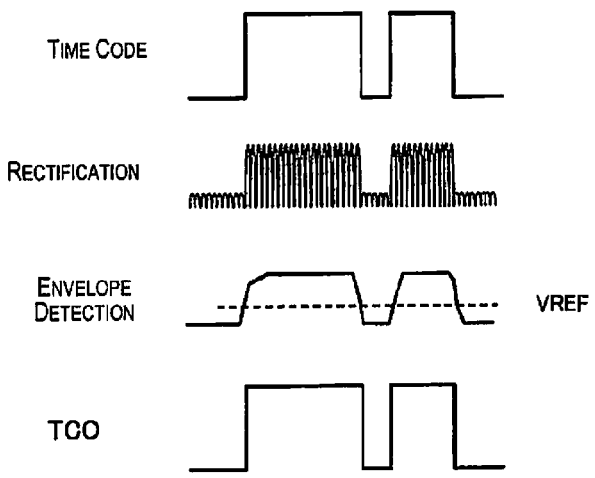
FIGS. 5A and 5B are a view illustrating respective waveforms in a case where an interference wave is not generated, and a view illustrating respective waveforms in a case where an interference wave is generated, respectively.
Figure 5B:
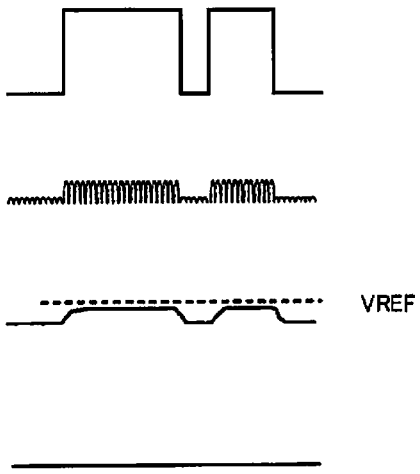

In a case where the received signal inputted from the second amplifier circuit 34 has not been strongly impacted by magnetic noise and was received correctly, then the envelope signal that is rectified, filtered, and outputted by the wave detector circuit 351 will be as illustrated in FIG. 5A. When an envelope signal that swings to the positive side and to the negative side at an amplitude of a predetermined value or greater, the threshold value for which is a reference signal VREF such as is illustrated in FIG. 5A, is inputted to the AGC circuit 36, then the AGC circuit outputs to the first amplifier circuit 32 a signal for making the gain be not more than the predetermined reference value.

In a case where the received signal inputted from the second amplifier circuit 34 is weak, however, then the envelope signal that is rectified, filtered, and outputted by the wave detector circuit 351 will have an amplitude that is less than the predetermined value, even though the signal may swing to the positive side and the negative side for which the threshold value is the reference value VREF. In a case where the received signal inputted from the second amplifier circuit 34 has been strongly impacted by magnetic noise, then the envelope signal that is rectified, filtered, and outputted by the wave detector circuit 351 will be as illustrated in FIG. 5B. When an envelope signal for which the amplitude is less than the predetermined value or, alternatively, an envelop signal of a lower level than the reference signal VREF such as illustrated in FIG. 5B is inputted to the AGC circuit 36, then the AGC circuit 36 outputs to the first amplifier circuit 32 a signal for making the gain be not less than the predetermined reference value.

The receipt time determination unit 472 discerns whether an error detection signal has been outputted from the TCO decoder unit 41 (step S20) in a case where it has been discerned that the gain determined by the AGC circuit 36 is less than the reference value (step S10: NO). In a case where it has been discerned that an error detection signal has not been outputted (step S20: NO), then the receipt time determination unit 472 terminates the process without modifying the receipt time. In this manner, in a case where the amplitude of the received signal is a predetermined value or greater and the time code does not include an error, then the received signal is believed not to have been impacted by noise and therefore the receipt time is not modified.

In a case where it has been discerned that an error detection signal has been outputted from the TCO decoder unit 41 (step S20: YES), however, then the receipt time determination unit 472 causes the receipt time to temporarily be a different time (step S30). The receipt time has been initialized at, for example, 2:00 AM, and when receipt is successful then the time is calibrated and receipt occurs again 24 hours later. There are, however, some instances where the amplitude of the received signal is not less than the predetermined value, and yet an error detection signal is outputted and the time code includes an error signal, as stated above. For example, when some kind of external noise is temporarily superimposed onto the received signal of the standard radio waves, then the signal will be different from the actual signal. Therefore, in such a case, the receipt time is temporarily made to be, for example, one hour later, at 3:00, and automatic receipt is again performed. When receipt is successful at this time, then the time is calibrated and the receipt time is again returned to 2:00 AM, which is the initially set time. The receipt time is also returned to 2:00 AM, which is the initially set time, in a case where an error detection signal is outputted and the time code includes an error signal regardless of if the amplitude of the received signal is not less than the predetermined value at this time, as well. As a result, receipt is performed again 23 hours later, at 2:00 AM. In this manner, the receipt time is temporarily made to be a different time in a case where the amplitude of the received signal is not less than the predetermined value and the impact of noise on the received signal is regarded as being temporary. As described above, the receipt time determination unit 472 functions as a receipt time determination unit for discerning that the received signal has been impacted by noise and modifying the receipt time in a case where the output of the automatic gain control circuit is less than the reference value and it is discerned that the time code has an error by the error discernment unit.

In a case where it has been discerned that the gain determined by the AGC circuit 36 is not less than the reference value (step S10: YES), however, then the receipt time determination unit 472 discerns whether an error detection signal has been outputted from the TCO decoder unit 41 (step S40). In a case where it has been discerned that an error detection signal has not been outputted (step S40: NO), then the receipt time determination unit 472 terminates the process without modifying the receipt time. The time when it is discerned that the gain determined by the AGC circuit 36 is not less than the reference value is a case where the amplitude of the received signal is less than the predetermined value. In such a case, the fact that the time code does not include an error is believed to mean that the received signal has not been impacted by noise and that the radio waves are weak, and therefore the gain is increased and the receipt time is not modified.

However, the receipt time determination unit 472 discerns that an error detection signal has been outputted from the TCO decoder unit 41 (step S40: YES), and discerns whether an interference wave detection signal has been outputted from the TCO decoder unit 41 (step S50). The first amplifier circuit 32 ends up being saturated when, for example, magnetic noise in the vicinity of the longwave band (30 to 300 kHz) generated by electrical machines that carry out non-contact charging wirelessly becomes interference waves and the received signal inputted from the second amplifier circuit 34 is strongly impacted by these interference waves. As a result thereof, the envelope signal that is rectified, filtered, and outputted by the wave detector circuit 351 will be an envelope signal of a lower level than the reference signal VREF, as illustrated in FIG. 5B, and is inputted to the AGC circuit 36. When such an envelope signal is inputted, the AGC circuit 36 outputs to the first amplifier circuit 32 a signal for having the gain be the maximum. The first amplifier circuit 32 will be saturated continuously, and the TCO signal that is outputted from the demodulating circuit 35 will not be outputted properly, becoming instead a signal that maintains a low level, as illustrated in FIG. 5B. In such a case, the time code will be data that has only zeroes; such a time code is acquired continuously for a predetermined duration, and it is impossible to properly calibrate the time. Moreover, the usage of electrical machines that carry out non-contact charging wirelessly can be regarded as always taking place at set times. As such, in this case, for example, the receipt time that was set to 2:00 AM is modified to one hour later, at 3:00. As a result thereof, automatic receipt is carried out again at 3:00, and should receipt be successful this time, then the time is calibrated. Then, thenceforth, the receipt time will not be returned to 2:00 AM, at which time the interference waves are believed to have an impact, but instead is set to 3:00, at which time correct receipt will have become possible. However, in a case where, even at the 3:00 receipt, the amplitude of the received signal is still less than the predetermined value, the error detection signal is outputted, and moreover the interference wave detection signal is outputted, then the receipt time is modified to yet another different time. As such, the receipt time determination unit 472 functions as a receipt time determination unit for discerning that the received signal has been impacted by noise and modifying the receipt time in a case where the output of the automatic gain control circuit is not less than the reference value, where it is discerned that the time code has an error by the error discernment unit, and where it is discerned that data of a time code that has only zeroes has been acquired over a predetermined duration or longer by the interference wave discernment unit.

As described, according to the present embodiment, the receipt time is modified not only in a case where the received signal is temporarily impacted by noise but also in a case where the received signal is impacted strongly by magnetic noise created by an electrical machine for which the usage time slot is believed to be fixed to a certain extent, e.g., an electrical machine that carries out non-contact charging wirelessly; therefore, receipt error by automatic receipt can be avoided and the success rate of automatic receipt can be improved. Moreover, it becomes possible to reduce the number of iterations due to receipt error and thereby reduce the power consumed by unnecessary receipt operations.

MODIFICATION EXAMPLES

The present invention is in no way limited to the embodiment described above, and a variety of modifications are possibly, such as, for example, shall be described below. Any optionally selected one or plurality of the modes of modification described below can also be combined as appropriate.

Modification Example 1

In the embodiment above, the control unit 47 and the TCO decoder unit 41 were described as being individual constituent elements, but the control unit 47 may be endowed with the function of the TCO decoder unit 41 described above.

Modification Example 2

The embodiment above describes an example where the discerning of whether or not there is an error is to discern that there is an error in a case where the data is such that there cannot be a time code or to discern that there is an error in a case where the parity does not match. However, the present invention is not limited to such an example. Either another method may be utilized, or a plurality of methods may be combined. The discerning may also be to discern that there is an error the first time when the number of time that it is discerned that there is an error has reached a predetermined number of times.

Modification Example 3

In an example regarding of the functions of the present invention as described above, a control program may be incorporated into a computer provided with a central processing unit (CPU), memory (storage apparatus), and the like to achieve functions as respective control units of a control circuit unit 400; when a computer is thus made to function as, for example, the control unit 47, the TCO decoder unit 41, and the time counter 43, then a variety of calibrations, setting modifications, and the like can be easily carried out. This control program may be installed via a communicating means such as the Internet, or via a recording medium such as a CD-ROM or memory card.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only a selected embodiment has been chosen to illustrate the present invention, it will be apparent to those skilled in the art from this disclosure that various changes and modifications can be made herein without departing from the scope of the invention as defined in the appended claims. Furthermore, the foregoing descriptions of the embodiment according to the present invention are provided for illustration only, and not for the purpose of limiting the invention as defined by the appended claims and their equivalents.

What is claimed is:

1. A radio timepiece configured to receive standard radio waves having a time code and calibrate a time based on the standard radio waves, the radio timepiece comprising:

an amplifier circuit configured to amplify a received signal of the standard radio waves;

an automatic gain control circuit configured to adjust a gain of the amplifier circuit in accordance with strength of the received signal;

a demodulating circuit configured to demodulate the received signal;

a decoder unit configured to decode a signal demodulated by the demodulating circuit to acquire the time code;

an error discernment unit configured to detect an error in the time code acquired by the decoder unit, an interference wave discernment unit configured to detect an interference wave based on data of the time code acquired by the decoder unit; and a receipt time determination unit configured to modify a receipt time based on an output of the automatic gain control circuit, detection result of the error discernment unit, and detection result of the interference wave discernment unit.

2. The radio timepiece as set forth in claim 1, wherein the interference wave discernment unit is further configured to discern whether or not the time code acquired by the decoder unit has only zeroes and the time code having only zeroes is acquired over a predetermined duration or longer.

3. The radio timepiece as set forth in claim 1, wherein the error discernment unit is further configured to discern whether or not the time code acquired by the decoder unit has the error, the interference wave discernment unit is further configured to discern whether or not the time code acquired by the decoder unit has only zeroes and the time code having only zeroes is acquired over a predetermined duration or longer, and the receipt time determination unit is further configured to determine that the received signal is impacted by the noise and modify the receipt time in a case where the output of the automatic gain control circuit is a reference value or greater, the error discernment unit discerns that the time code has the error, and the interference wave discernment unit discerns that the time code having only zeroes is acquired over the predetermined duration or longer.

4. The radio timepiece as set forth in claim 3, wherein the receipt time determination unit is further configured to determine that the received signal is impacted by the noise and modify the receipt time in a case where the output of the automatic gain control circuit is less than the reference value and the error discernment unit discerns that the time code has the error.

5. A receipt control method for a radio timepiece configured to receive standard radio waves having a time code and calibrate a time based on the standard radio waves, the receipt control method comprising:

amplifying a received signal of the standard radio waves by an amplifier circuit;

adjusting a gain of the amplifier circuit by an automatic gain control circuit in accordance with strength of the received signal;

demodulating the received signal by a demodulating circuit;

decoding, by a decoder unit, a signal demodulated by the demodulating circuit to acquire the time code;

detecting, by an error discernment unit, an error in the time code acquired by the decoder unit;

detecting, by an interference wave discernment unit, an interference wave based on data of the time code acquired by the decoder unit; and modifying, by a receipt time determination unit, a receipt time based on an output of the automatic gain control circuit, detection result of the error discernment unit, and detection result of the interference wave discernment unit.

6. The radio timepiece as set forth in claim 1, wherein the receipt time determination unit is further configured to modify the receipt time in response to the error discernment unit detecting the error in the time code acquired by the decoder unit and in response to the interference wave discernment unit detecting the interference wave based on the data of the time code acquired by the decoder unit.

* * * * *